US005435103A

United States Patent [19]

Lauesen et al.

[11] Patent Number: 5,435,103

[45] Date of Patent: Jul. 25, 1995

[54] COMPACT WINDOW OPERATOR

[75] Inventors: Jesper Lauesen, Birkerod; Bjarne Borresen, Soborg, both of Denmark

[73] Assignee: V. Kann Rasmussen Industri A/S, Soborg, Denmark

[21] Appl. No.: 76,126

[22] Filed: Jun. 14, 1993

[51] Int. Cl.[6] ..... E05F 1/10

[52] U.S. Cl. ..... 49/386; 49/324

[58] Field of Search ..... 49/386, 339, 340, 341, 49/344, 345, 346, 324

[56] References Cited

U.S. PATENT DOCUMENTS

| | | | |
|---|---|---|---|
| 2,698,173 | 12/1954 | Rydell . | |
| 2,767,979 | 10/1956 | Hummert . | |
| 4,521,993 | 6/1985 | Tacheny et al. . | |
| 4,553,656 | 11/1985 | Lense | 49/139 X |
| 5,097,629 | 3/1992 | Guhl et al. . | |
| 5,179,803 | 1/1993 | Lense . | |
| 5,205,074 | 4/1993 | Guhl et al. | 49/386 |

FOREIGN PATENT DOCUMENTS

| | | | |
|---|---|---|---|
| 1351096 | 12/1963 | France | 49/340 |
| 186760 | 6/1907 | Germany . | |
| 824752 | 11/1951 | Germany . | |
| 9003179 | 7/1990 | Germany . | |
| 324587 | 11/1957 | Switzerland . | |
| 1132744 | 11/1968 | United Kingdom . | |

OTHER PUBLICATIONS

English translation of German Patent 186,670.
English translation of German Patent 824,752.
English translation of German Utility Model No. 90 03 179.2.
English translation of Swiss Patent 324,587.

*Primary Examiner*—Jerry Redman
*Attorney, Agent, or Firm*—Lane, Aitken & McCann

[57] ABSTRACT

A compact counterbalanced window operator includes a housing in which operating arms pivotally connected in the housing and slidingly and pivotally connected to a sash of the window are counterbalanced by a torsion spring. In one embodiment, connections between the torsion spring and the operating arms are adjustable in order to vary the counterbalancing force applied to the operating arms.

15 Claims, 12 Drawing Sheets

COMPACT WINDOW OPERATOR

BACKGROUND OF THE INVENTION

The present invention relates to an operator unit for opening and closing a window and, more particularly, to a compact counterbalanced window operator.

Operators are known for moving a window between closed and open positions, for example, a window having a stationary main frame mounted in a roof of a house or other building, especially a sloped roof, and a sash hinged to the main frame at the top of the sash for pivoting toward and away from the main frame. Such operators are typically mounted on a bottom member of the main frame and connected to a bottom member of the sash for pushing the sash away from the main frame and drawing the sash into engagement with the main frame. When the window operator is actuated to move the window in an opening direction, it must overcome a component of the weight of the sash, especially when the window is mounted in a roof. In order to overcome this difficulty, counterbalancing devices employing springs have been provided to counteract the weight component of the window and, thereby, reduce the force which must be applied to the operator, either by hand or by a power unit. Counterbalanced window operators are disclosed in U.S. Pat. Nos. 5,097,629 to Guhl et al. and 2,698,173 to Rydell. Such counterbalanced window operators are characterized by large housings to accommodate the springs or by springs taking up considerable space outside the housings.

SUMMARY OF THE INVENTION

The construction according to the present invention offers the advantage that a very compact design of high stability and functional reliability is obtained so that, in the closed condition of the window, the moving means of the operating member between the sash and the main frame may be completely accommodated in a fairly small housing mounted on the bottom of the main frame. In addition, the counterbalancing force applied by the spring can be adjusted by the user without dismounting the housing. 54363825.001

DETAILED DESCRIPTION OF THE PREFERRED EMBODIMENTS

Figure 1:
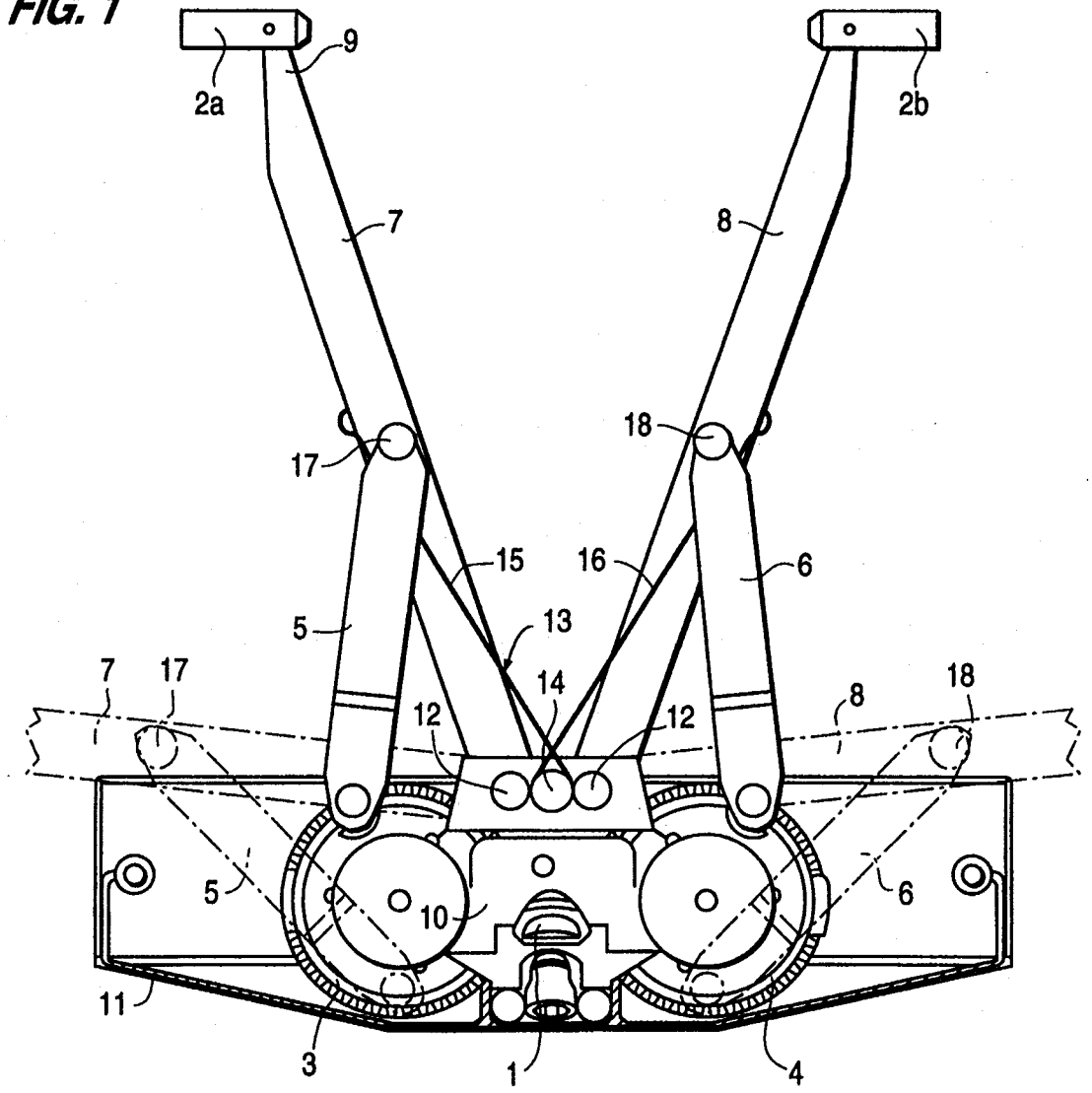
FIG. 1 is a schematic view of a first embodiment of a window operator according to the present invention, with the housing cover removed.

Common features of all of the embodiments of the counterbalanced window operator according to the present invention which are illustrated in the drawings are that a connection between a sash of a window and an operator housing 11 (or 11*a* in the embodiments of FIGS. 11 and 12), which is mounted, e.g., at a bottom member of the main frame of the window, is provided by two pivoting arms 7–8 and 7*a*–8*a*, respectively, one end of each of which is pivotally journalled about a pivot point in the housing 11, 11*a*. The other end of each pivoting arm 7–8, 7*a*–8*a* is pivotally connected with a bottom member S of the sash by means of slide shoes 2*a*–2*b* slidably displaceable in the longitudinal direction of that member in tracks of a track member T secured on the bottom member S, as can be seen from FIG. 6.

Figure 4:
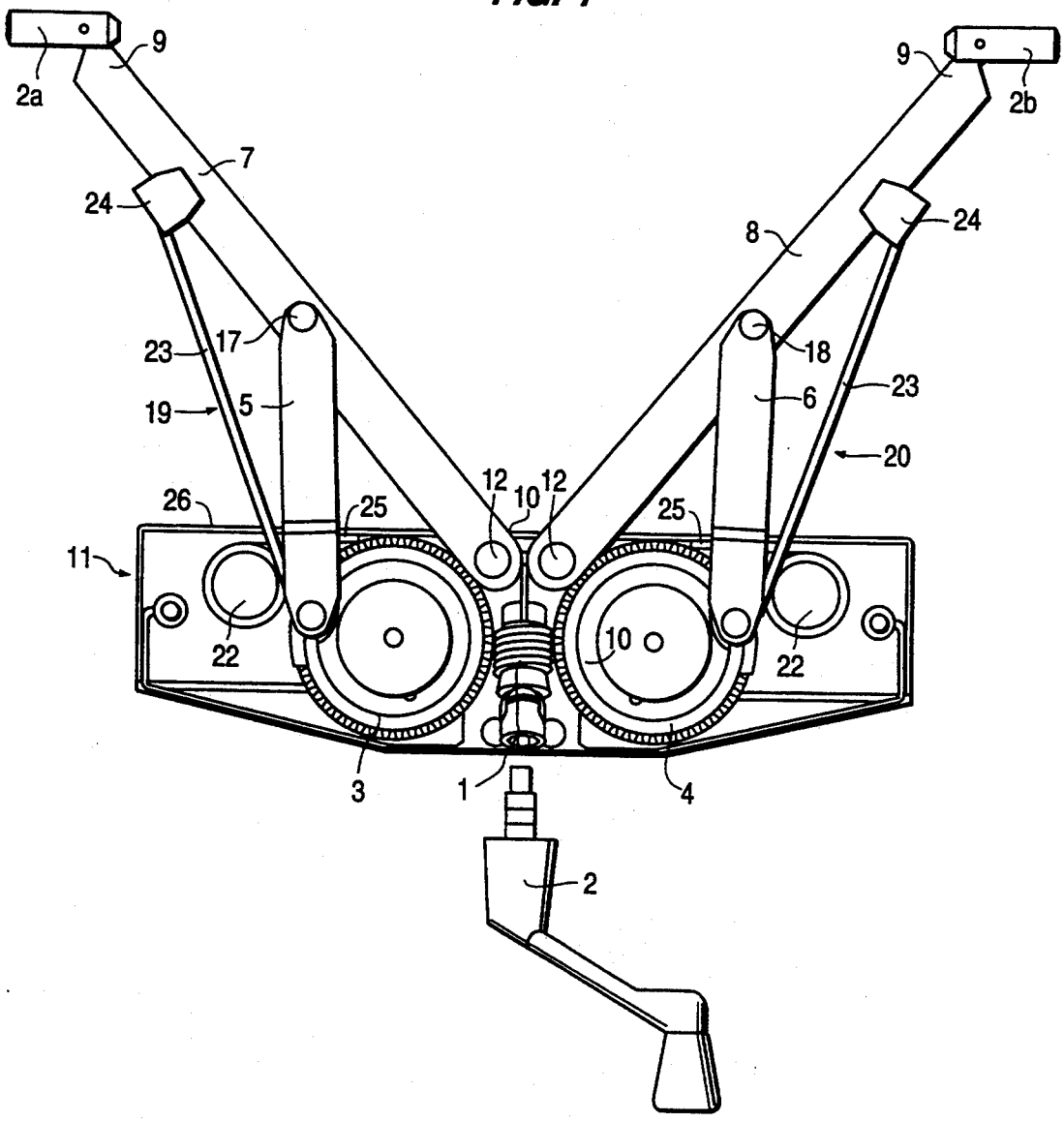
FIG. 4 is a schematic view of the window operator of FIG. 3 with an operating handle shown in exploded position and an internal central cover plate removed.
Figure 11:
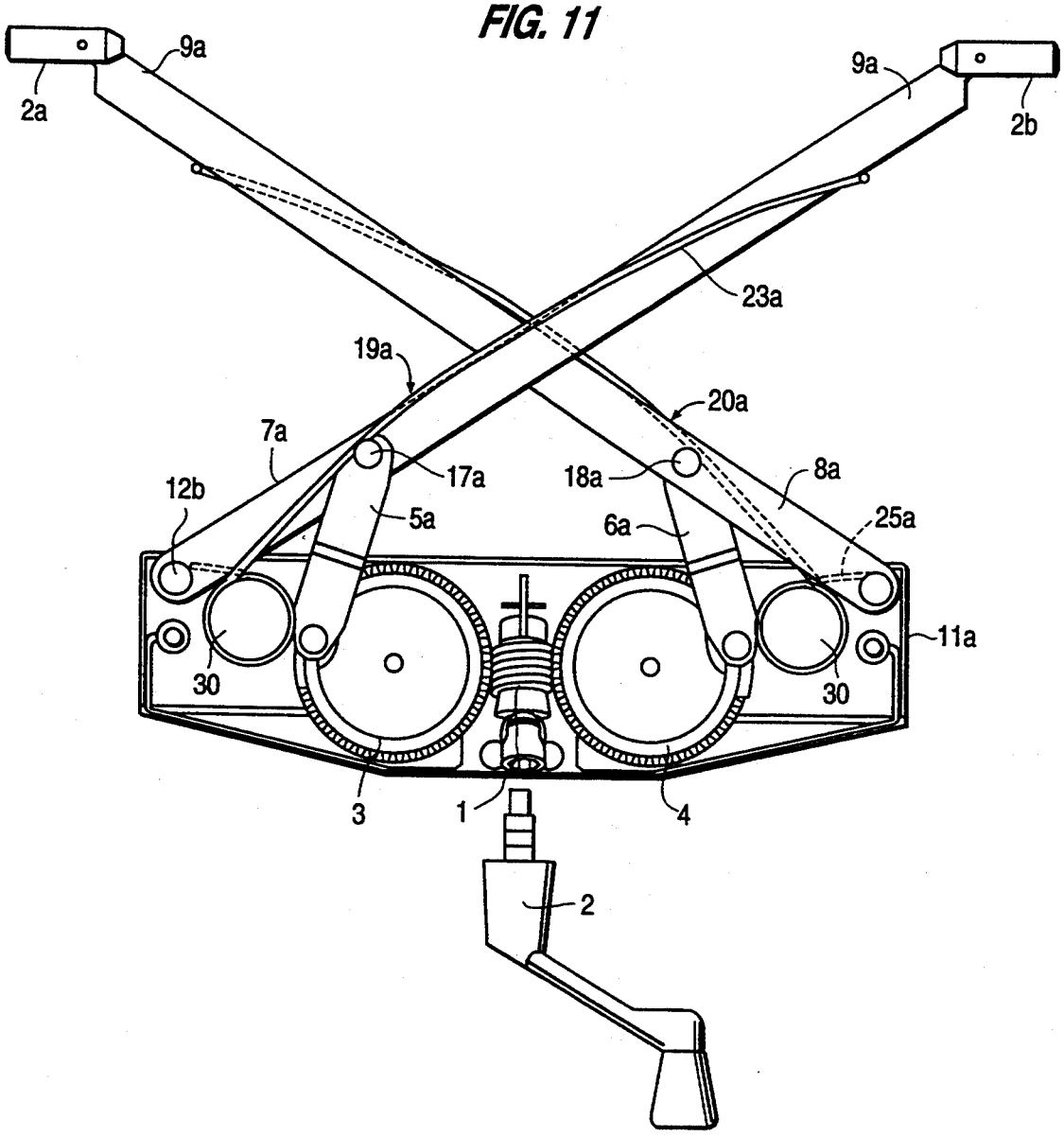
FIG. 11 is a schematic view of a fifth embodiment of a window operator according to the present invention, with an operating handle shown in exploded position and the housing cover and an internal central cover plate removed.
Figure 12:
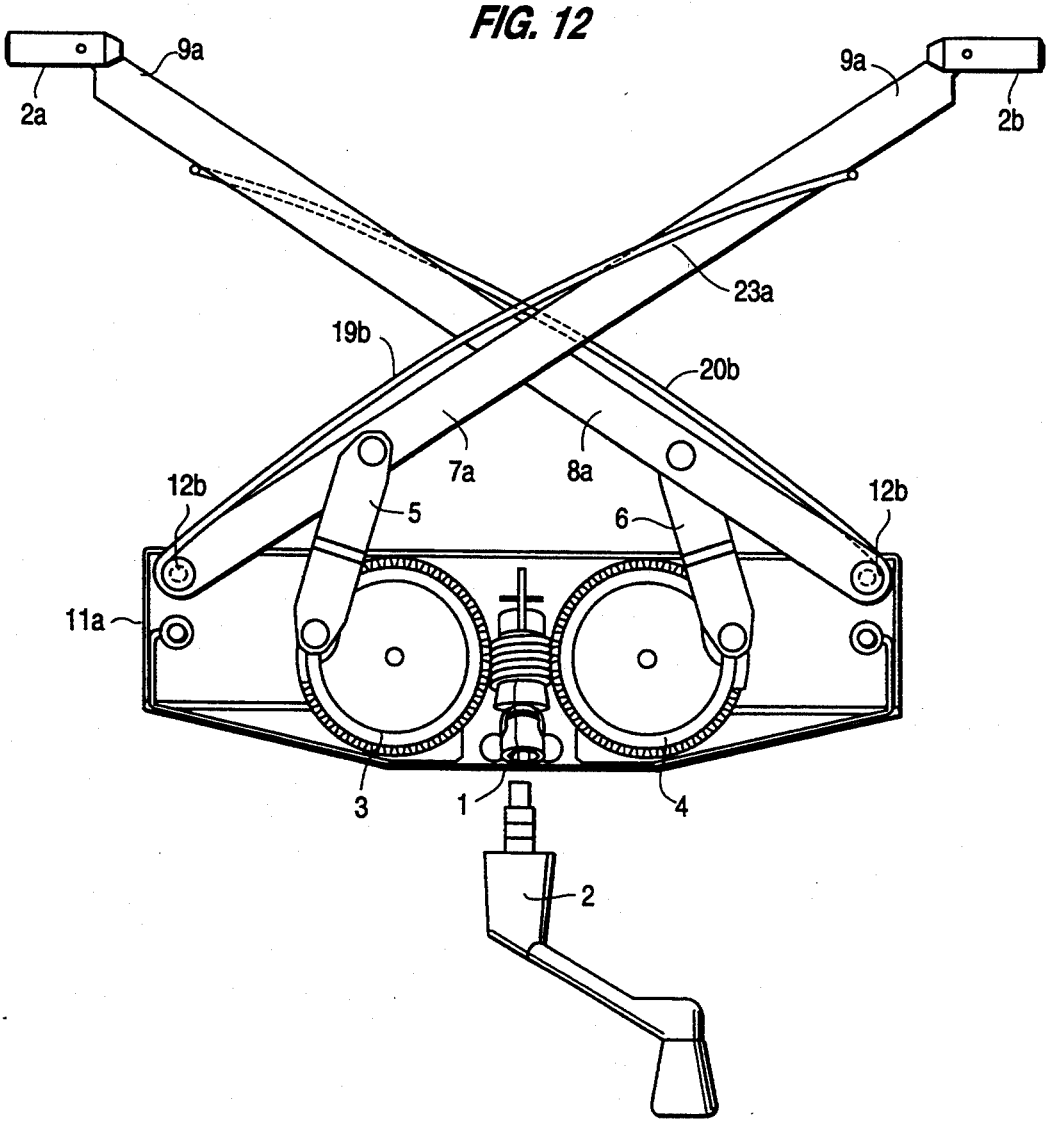
FIG. 12 is a schematic view of a sixth embodiment of a window operator according to the present invention, with an operating handle shown in exploded position and the housing cover and an internal central cover plate removed.

Since a cover for the housing is removed from most of its drawing figures for purposes of illustration, it can be seen that the drive members for the opening movement are wheel gears 3, 4 mounted for rotation in the housing 11 or 11*a*, the gears having peripheral teeth engaged by a rotatable worm member 1 operated by cranking the handle 2 (FIGS. 4, 11 and 12). The handle 2 is received in driving engagement in an end of the worm member 1. A thrust bearing (not shown) is provided to prevent axial movement of the worm member 1, whether the worm member is rotated clockwise or counterclockwise. An internal central cover plate 10 covers portions of the worm member 1 and the gears 3, 4.

The connections between the gears 3, 4 and the pivotal arms 7–8, 7*a*–8*a* are provided by a symmetrical pair of links 5–6, 5*a*–6*a*, respectively, each link having one end pivotally and eccentrically connected with the associated gear 3, 4 and another end pivotally connected with the respective arm 7–8, 7a–8a, respectively, at a point located some distance from the end of the arm pivotally journalled in the housing 11, 11a.

In each illustrated embodiment, a symmetrical arrangement of a counterbalancing torsion spring mechanism is provided to facilitate the opening movement of the window by compensating for the weight of the window.

Figure 7:
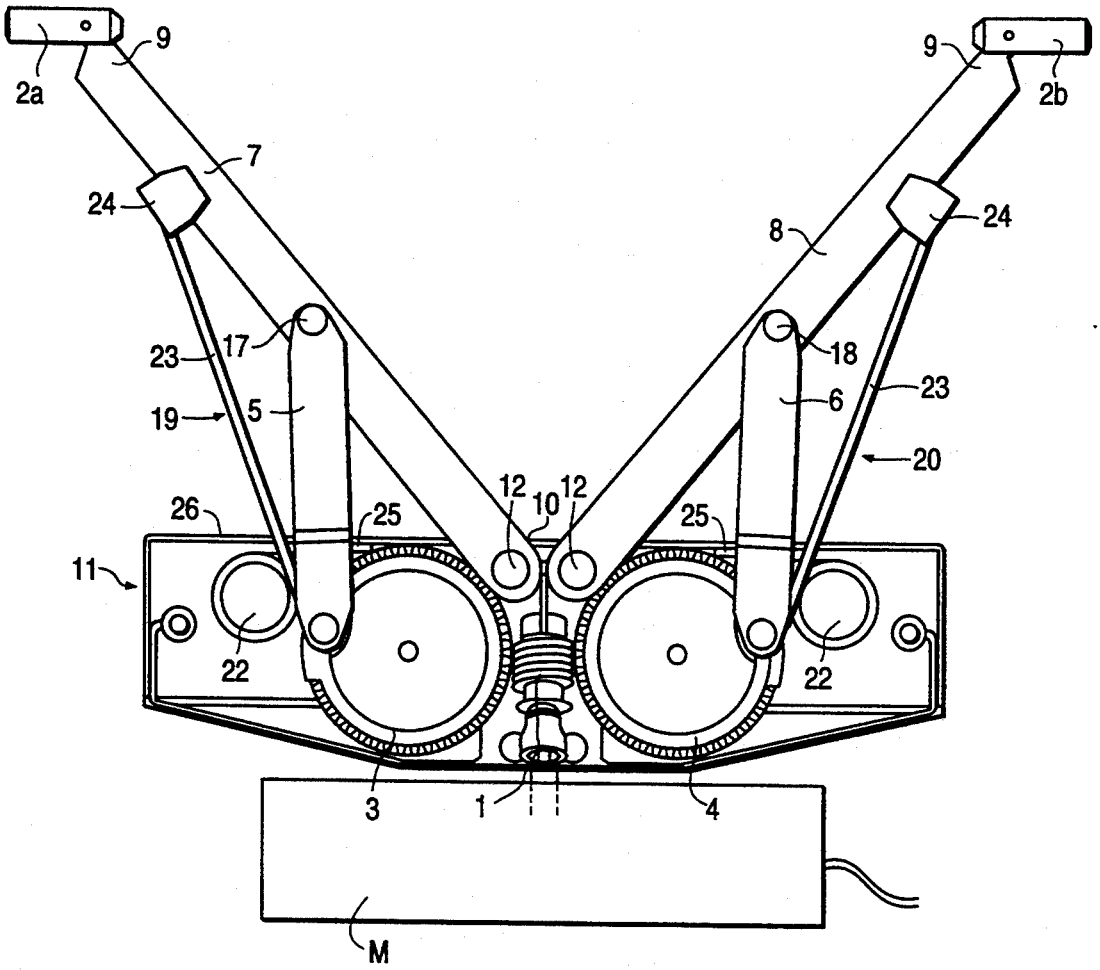
FIG. 7 is a schematic view of the window operator of FIG. 3 with an electric drive unit connected and an internal central cover plate removed.

The worm member 1 can be operated either by the manually manipulable handle 2 or by an electric drive unit M (FIG. 7). The worm member 1 is engaged on diametrically opposite sides by the gears 3 and 4, each of which is connected via the link member 5–6, 5a–6a, respectively, with one of the operator arms 7–8, 7a–8a, respectively. For the operator arms 7–8, 7a–8a, common features are that a first end 9, 9a of each arm is pivotally and slidably connected with the track T on the bottom member S of the sash by a slide shoe 2a–2b, whereas a second end 10, 10a is connected with a pivot point 12, 12a, 12b stationarily located in the housing 11, 11a. In FIG. 1, the operator is counterbalanced by a torsional spring 13 mounted on a stationary pin 14 in the housing 11 between pivot points 12. The spring 13 has legs, or fingers, 15 and 16 engaging a respective one of the operating arms 7 and 8 relatively close to pivot point connections 17 and 18 between the link members 5 and 6 on the arms 7 and 8. The ends of the legs 15, 16 curve around edges of the operating arms 7 and 8 and might slide relative thereto.

Figure 2:
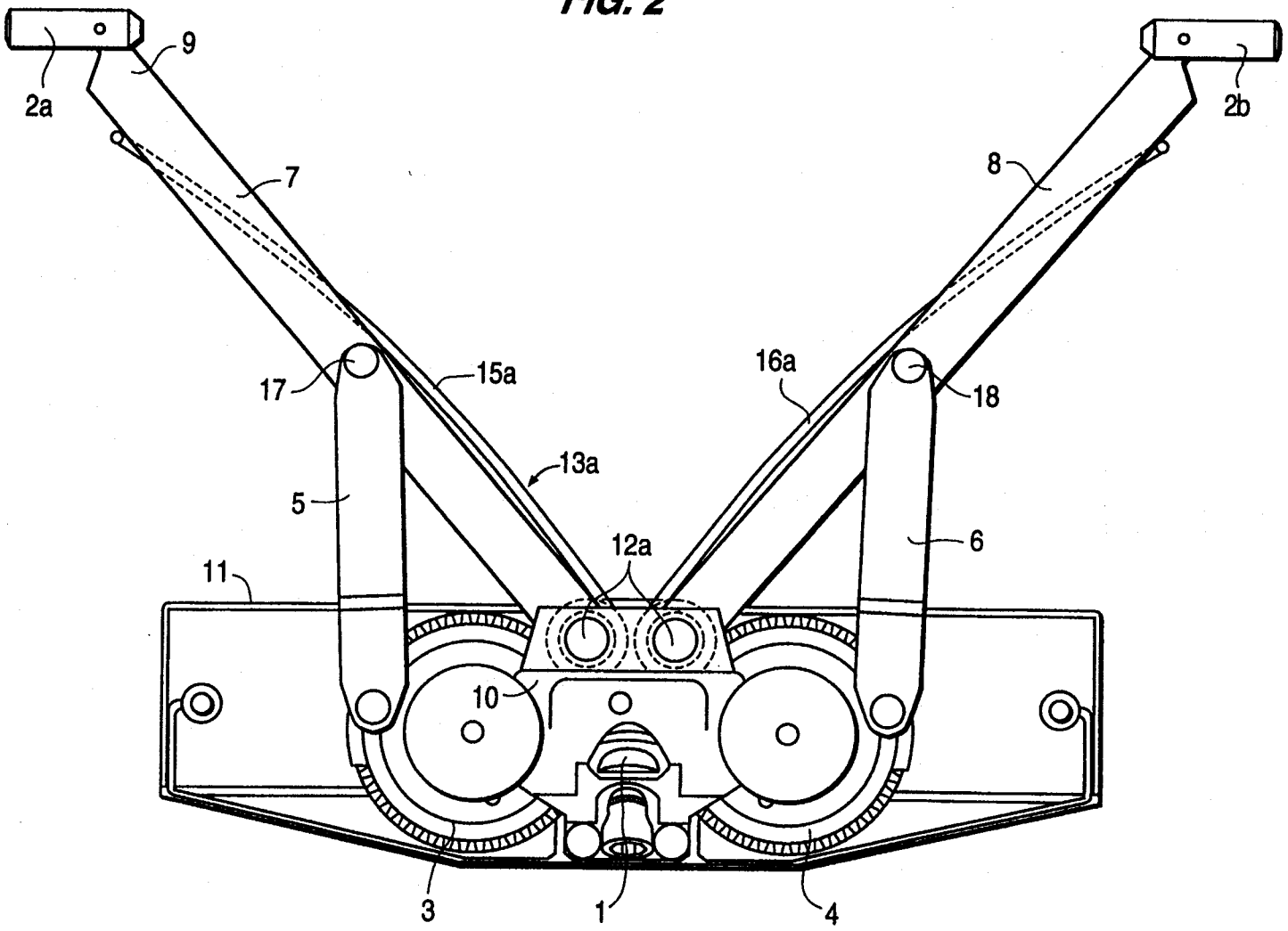
FIG. 2 is a schematic view of a second embodiment of a window operator according to the present invention, with the housing cover removed.

FIG. 2 shows a structure similar to that of FIG. 1 with the difference being that a torsional spring 13a with legs 15a and 16a is mounted on the pins forming pivot points 12a for the operating arms 7 and 8. The ends of the legs 15a, 16a curve around edges of the operating arms 7 and 8 and might slide relative thereto. As can be seen from FIG. 2, the spring legs 15a and 16a will assume a curved shape.

Figure 3:
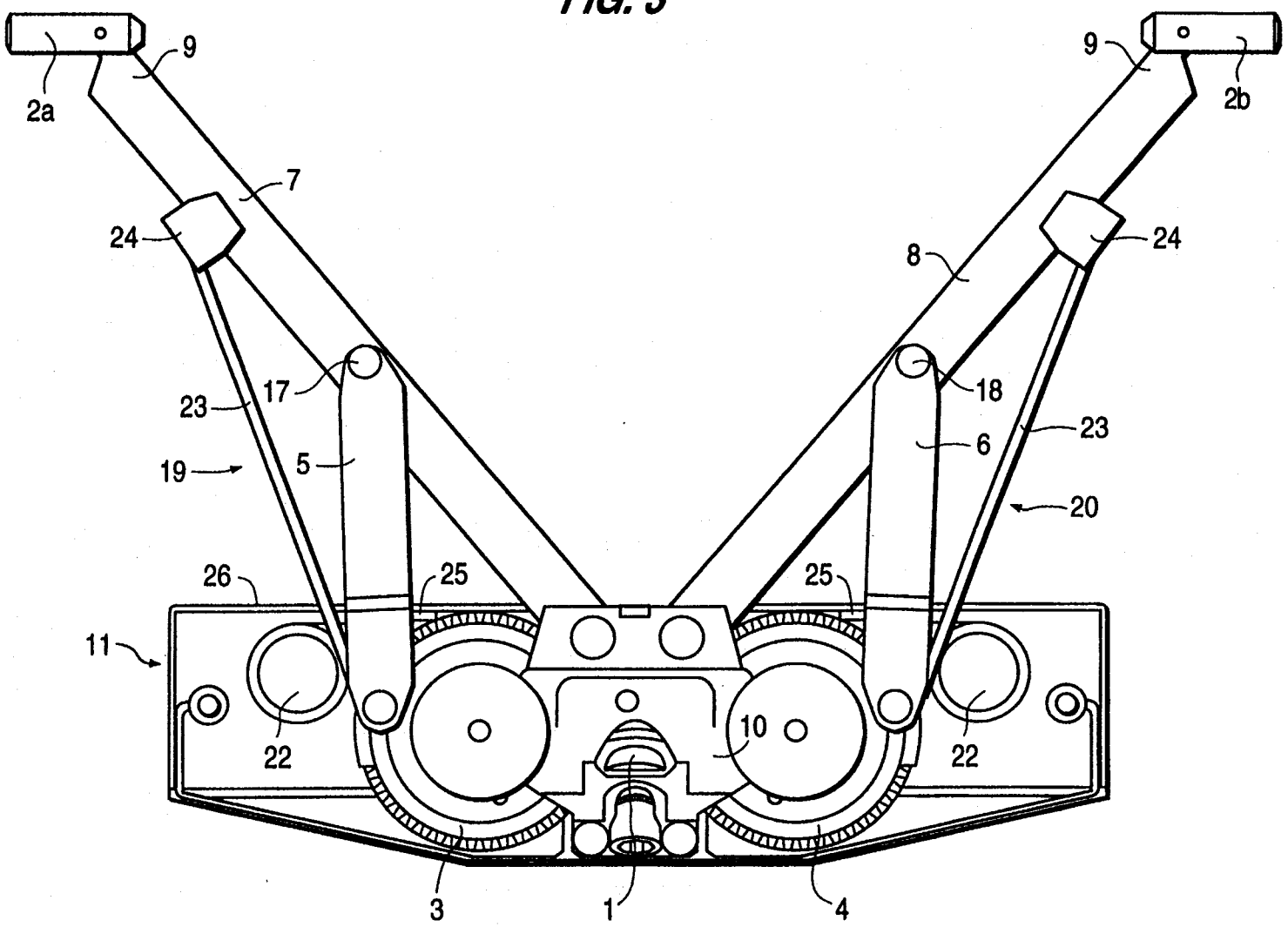
FIG. 3 is a schematic view of a third embodiment of a window operator according to the present invention, with the housing cover removed.
Figure 5:
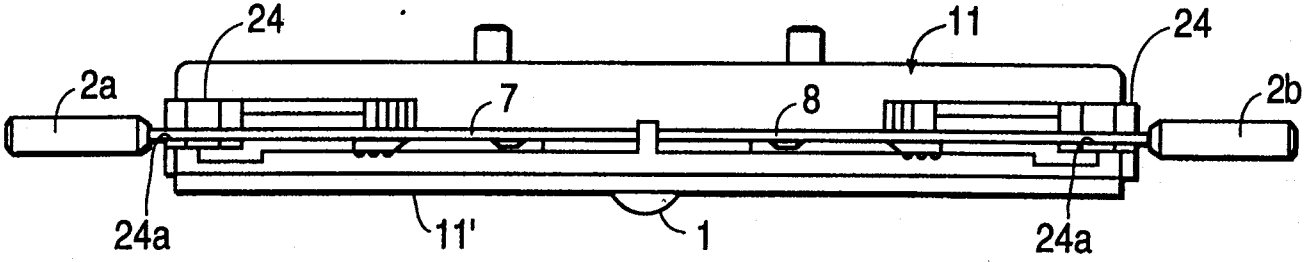
FIG. 5 is a schematic top view of the window operator of FIG. 3, with the housing cover in place.

FIGS. 3 and 4 show a structure in which two torsional springs 19 and 20 are used. Each spring is mounted on a stationary pin 22 in the housing and has one finger 23 connected at its free end to a slide shoe 24 engaging a side edge of a respective operating arm 7,8 and another finger 25 resting against a side wall 26 of the housing 11. Each slide shoe 24 has a slot 24a (FIG. 5) on the side facing the side edge of the respective operating arm to receive the arm. FIG. 5 is a side view of the operator of FIGS. 3 and 4 serving to illustrate the very compact nature of the window operator according to the present invention. In FIG. 5, a cover 11' for the housing 11 is shown in place.

FIG. 7 shows an electric drive unit M connected to the worm member 1 to drive the worm member, instead of using the handle 2.

Figure 8:
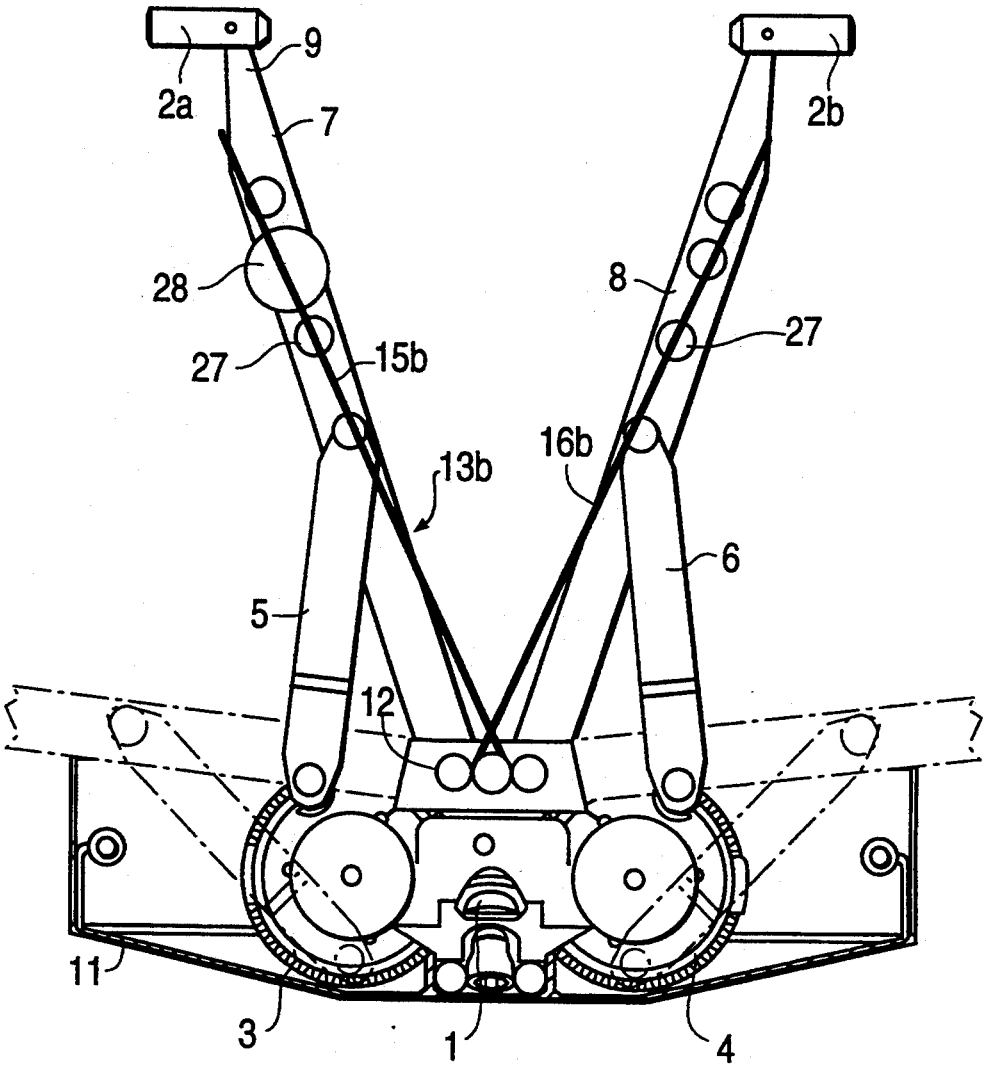
FIG. 8 is a schematic view of a fourth embodiment of a window operator according to the present invention, with the housing cover removed.
Figure 9:
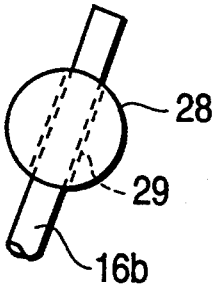
FIG. 9 is an enlarged view of a mounting member of the embodiment of FIG. 8.
Figure 10:
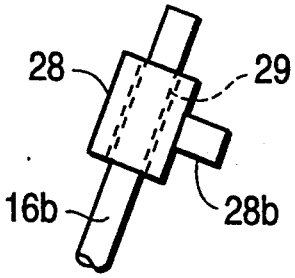
FIG. 10 is a right side view of the mounting member of FIG. 9.

FIG. 8 shows an embodiment in which an arrangement for adjusting the counterbalancing of the operating arms 7 and 8 is provided in the form of a series of holes 27 spaced in the longitudinal direction along each of the operating arms 7 and 8. The holes 27 are adapted to receive a mounting member 28 which can be fitted in any of the holes 27. As can best be seen from FIG. 9, the mounting member 28 has a bore 29 which slidably receives a corresponding spring finger 15b, 16b. As can best be seen from FIG. 10, each mounting member 28 includes a projection 28a which is removably received in any one of the holes 27. The projection 28b fits snugly in the holes 27, but in a manner which permits the mounting member 28 to pivot. By moving each mounting member 28 from one hole 27 to another, the user can adjust the spring force exerted on the operating arms 7, 8 without access to the interior of the housing 11. The positioning of the mounting members 28 in the holes 27 nearest the pivot points 12 of the operating arms 7, 8 provides the greatest counterbalancing force because the effective length of the spring legs 15b, 16b is reduced. Therefore, the force of the spring 13b is not as soft as when the mounting members 28 are placed in the farthest holes 27. Holes 27 might also be placed on the link members 5 and 6 to increase the torque of the spring 13b by bigger steps, because the torque delivered by the same torsion spring depends on the angle between the two legs.

Figure 13:
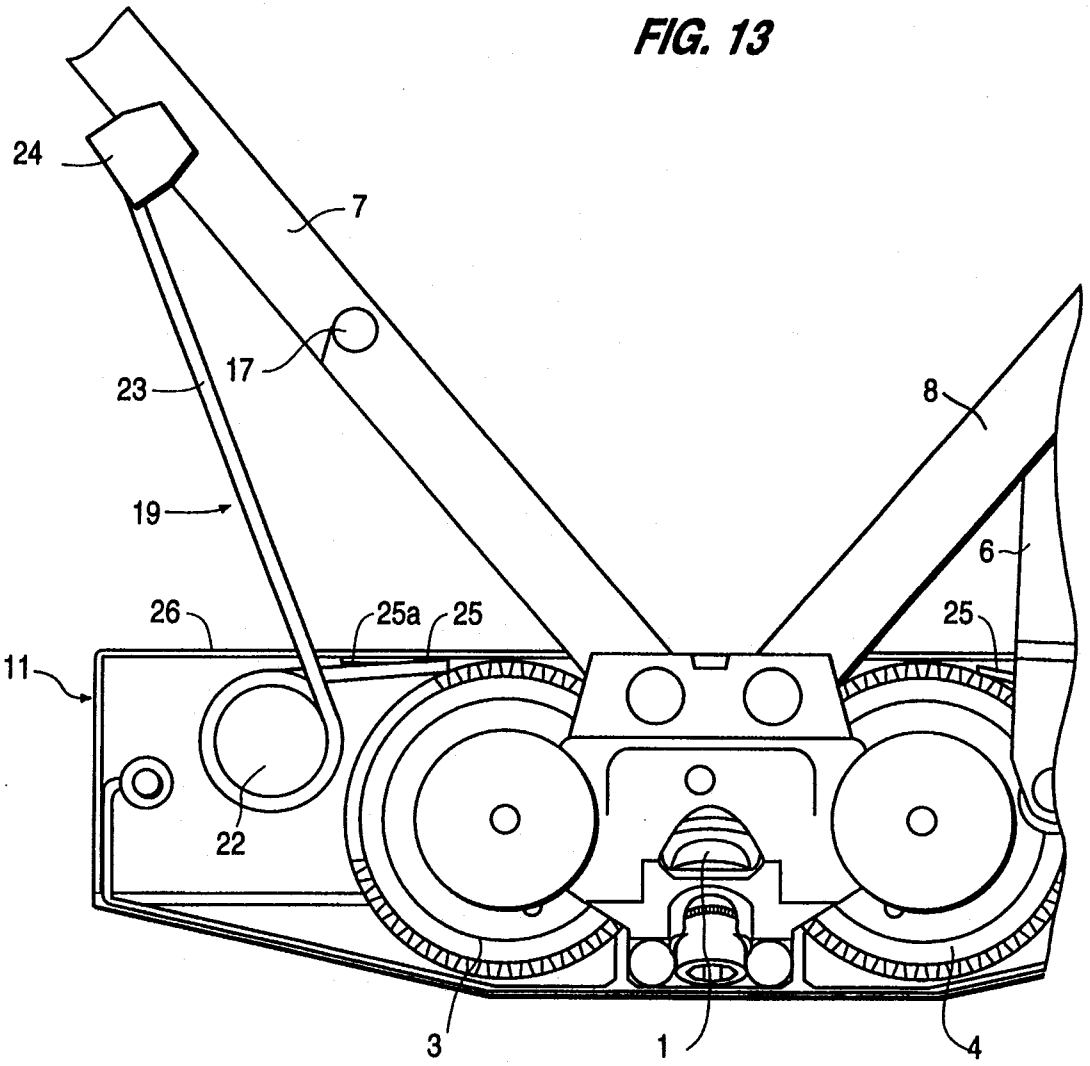
FIG. 13 is a partial schematic view of a seventh embodiment of a window operator according to the present invention, with the housing cover and a link member removed.
Figure 14:
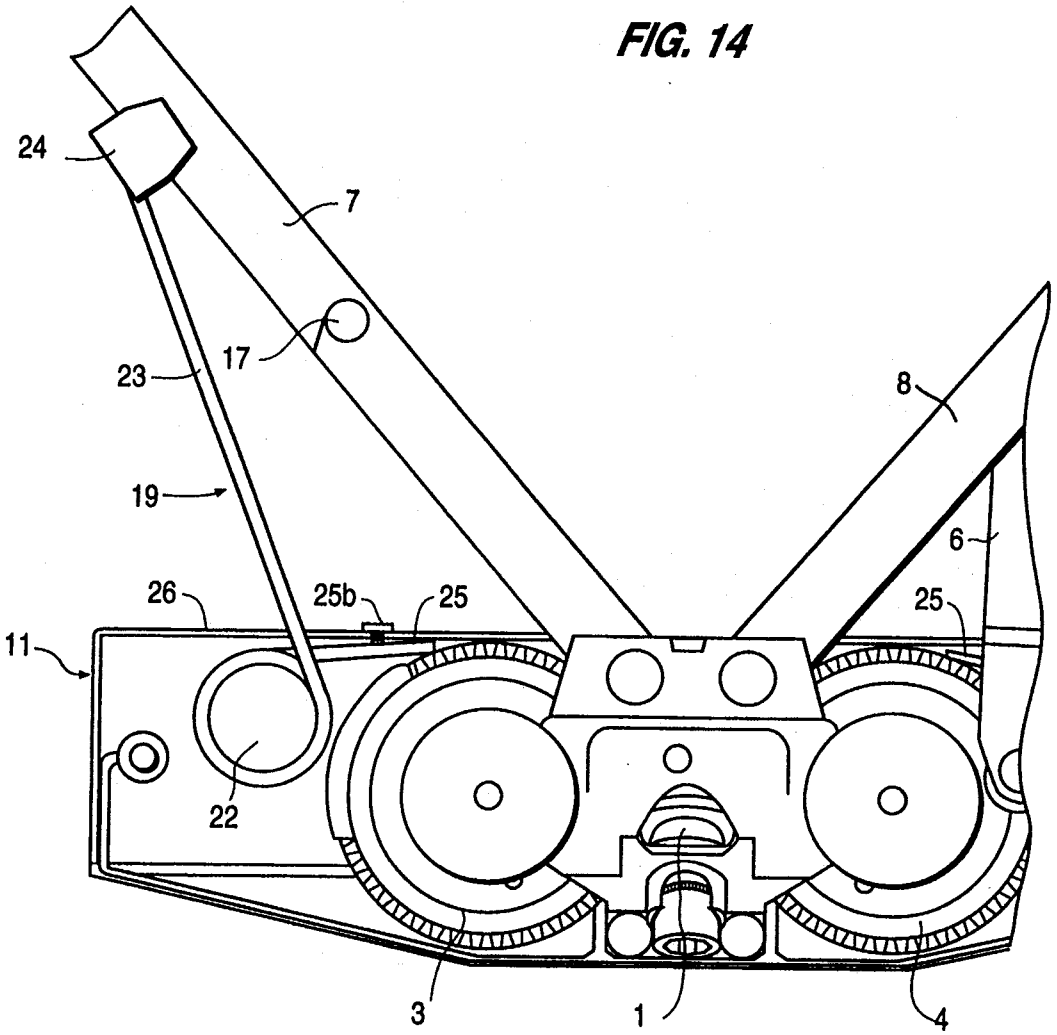
FIG. 14 is a partial schematic view of an eighth embodiment of a window operator of the present invention, with the housing cover and a link member removed.

The embodiments illustrated in FIGS. 13 and 14 are similar to the embodiment of FIGS. 3–5, except that a mechanism is provided for adjusting the counterbalancing force exerted by the springs 19 and 20 on the operating arms 7 and 8. In FIGS. 13 and 14, the link member 5 has been removed for the purpose of clearly illustrating the mechanisms. In the embodiment of FIG. 13, an interposed layer, or shim, 25a is positioned between the finger 25 of the torsional spring 19 and the side wall 26 of the housing 11. In the embodiment of FIG. 14, the mechanism for adjusting the counterbalancing force of the spring 19 is an adjusting screw 25b arranged in a threaded bore in the wall 26 of the housing 11. By turning the adjusting screw 25b in one direction or the other, the end of the spring leg 25 will be displaced to adjust the counterbalancing force. For the embodiments of both FIGS. 13 and 14, the mechanism for adjusting the counterbalancing force can be described only in relation to the counterbalancing spring 19, shown on the left side of the casings 11. It is understood that a like counterbalancing mechanism can be provided at the right side of the casing 11 to adjust the counterbalancing force of the counterbalancing spring 20, which is positioned at the right side of the housing 11.

Figure 6:
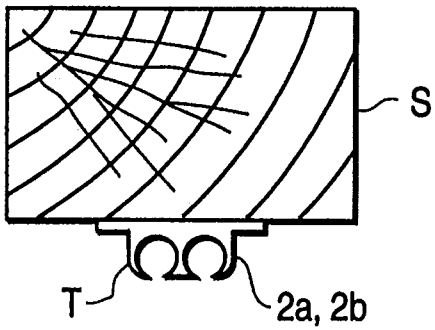
FIG. 6 is a cross-section of a portion of a window sash to which the operator according to the present invention is connected.

FIGS. 11 and 12 show embodiments in which pivot points 12b for the second end of each operating arm 7a and 8a have been displaced to opposite ends of the housing 11a so that operating arms 7a and 8a cross each other. With crossing arms, it is possible to use longer operating arms. This is advantageous in windows where the distance between the sides of the main frame is small. By using longer arms, such windows can be opened as far as bigger windows. For these embodiments, it is important that the track member T have two tracks, as is shown in FIG. 6, because the crossing of the arms 7a, 8a requires two tracks. In the embodiments of both FIGS. 11 and 12, two torsion springs are enclosed. In FIG. 11, the springs 19a and 20a are each mounted on a separate stationary pin 30 in the housing 11a, each spring having a finger 23a engaging a side edge of the corresponding operating arm 7a, 8a and a finger 25a resting against a side wall 26a of the housing 11a. In FIG. 12, torsion springs 19b and 20b are mounted on the pins 12b forming the pivot points. In FIGS. 11 and 12, the torsion springs again assume a curved shape. The ends of the springs 20a and 20b curve around the edges of the associated operating arms 8a, 9a and slide relative thereto.

In all embodiments, the operator is of a very compact design suitable for easy installation, even with existing window frames.

Figure 15:
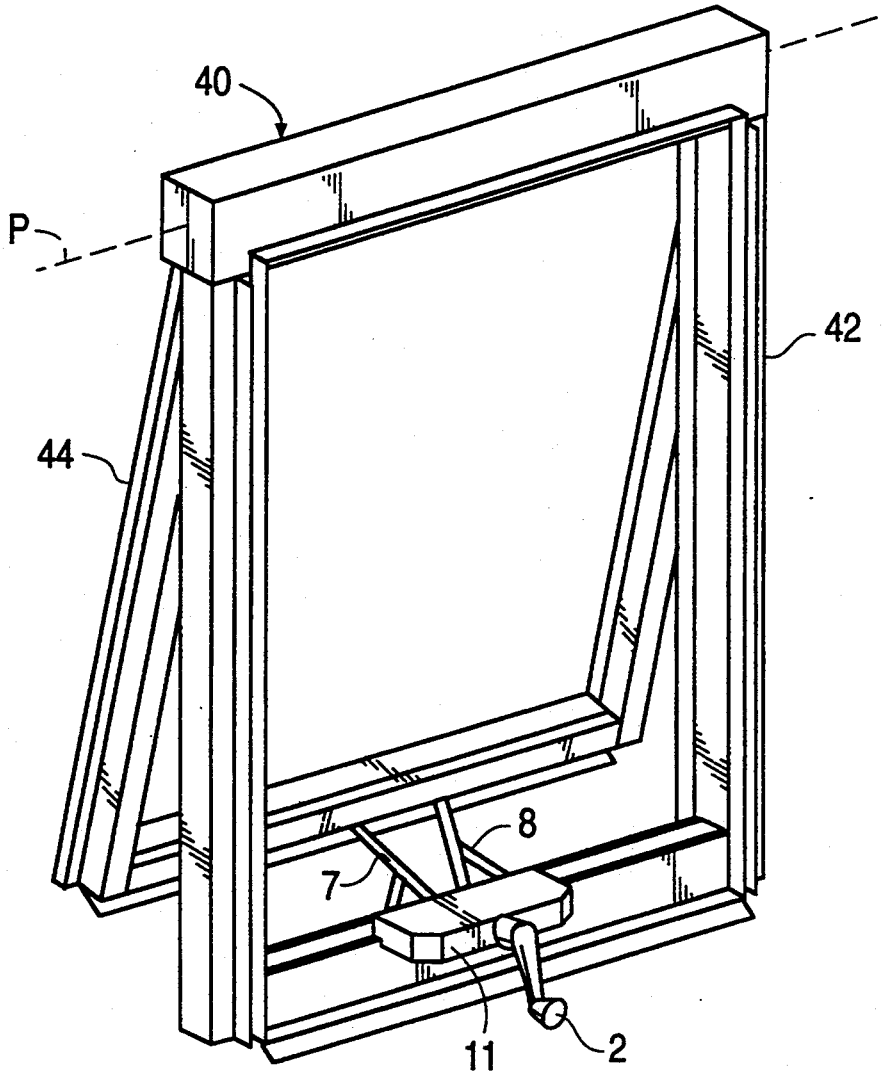
FIG. 15 is a schematic view of a window having a rectangular frame and a rectangular sash mounted for pivoting movement relative to the window frame and employing the window operator according to the present invention.

As can be seen from FIG. 15, the operator according to the present invention is for opening a window 40 having a generally rectangular main frame 42 and a generally rectangular sash 44 mounted for pivoting movement relative to the main frame about a pivot axis P generally parallel to a pair of opposed sides of the sash.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

We claim:

1. A compact window operator for opening and closing a window having a generally rectangular main frame and a generally rectangular sash mounted for pivoting movement relative to the main frame about a pivot axis generally parallel to a pair of opposed sides of said sash, comprising:

an essentially closed housing which is fixed with respect to said main frame, two arms, each said arm connected at a first end with one of the opposed sides of the sash and pivotally connected at a second end with a stationary pivot point which is located inside said housing, moving means arranged inside said housing for moving said arms about the pivot points, said moving means comprising a rotatable drive member journalled for rotation in said housing and a rotatable transmission member operatively connected with said arms and being engaged by said drive member to be rotated upon rotation of said drive member whereby to cause said arms to pivot about said pivot points, and torsional spring means operatively connected between a first point fixed with respect to said housing and a second point engaging a part of each said arm outside said housing for providing a counterbalancing force counteracting a weight component of the window, said torsional spring means comprising means for generating a biasing force which is exerted only in a direction tangential to a curved path about said first point.

2. The window operator of claim 1, wherein said torsional spring means comprises a torsion spring secured about a stationary pin in said housing, said torsion spring having fingers engaging said arms in said second points.

3. The window operator of claim 1, wherein said second points are formed by shoe members which are slidably displaceable in the longitudinal direction of said arms.

4. The window operator of claim 1, wherein displacement means are provided for displacement of said second points in the longitudinal direction of said arms for adjusting said counterbalancing force without dismantling said housing.

5. The window operator of claim 4, wherein said torsional spring means comprises a torsion spring secured about a stationary pin in said housing, said torsion spring having fingers engaging said arms at said second points, and said displacement means comprises a series of holes distributed in the longitudinal direction of said arms and mounting members fitting releasably in any of said holes and having bores adapted to slidably receive ends of said fingers of said torsion spring.

6. The window operator of claim 1, wherein said first ends of said arms are adapted for sliding connection with the sash of the window, whereas said pivot points are provided at second ends of said arms and located in said housing.

7. The window operator of claim 1, wherein the pivot points for said second ends of said two arms are located close to each other in a central part of said housing.

8. The window operator of claim 7, wherein said torsional spring means comprises a single torsion spring having two fingers, each of said fingers engaging a respective one of said arms, said stationary pin being arranged between said pivot points.

9. The window operator of claim 7 wherein said torsional spring means further comprises individual torsion springs for each of said two arms, each of said torsion springs having a first finger engaging a respective one of said arms and a second finger engaging a stationary part of said housing.

10. The window operator of claim 1, wherein the pivot points for said second ends of said two arms are located remote from each other at opposite ends of said housing.

11. The window operator of claim 10, wherein said torsional spring means comprises individual torsion springs for each of said two arms, each of said torsion springs having a first finger engaging a respective one of said arms and a second finger engaging a stationary part of said housing.

12. The window operator of claim 1, wherein said moving means further comprises a manually manipulatable member connected to said drive member for manual rotation of said drive member.

13. The window operator of claim 1, wherein said moving means further comprises an electrically powered drive unit connected to said drive member for rotating said drive member.

14. The window operator of claim 1, wherein said drive member comprises a worm member and said transmission member comprises two separate gears engaging said worm member at diametrically opposed sides thereof, each of said gears being operatively connected with a respective one of said arms through a link member pivotally connected with said gear and said arm.

15. The window operator of claim 1, wherein said second point is slidable along said part of said arm.

* * * * *